US011242752B2

(12) United States Patent
Ma et al.

(10) Patent No.: US 11,242,752 B2
(45) Date of Patent: Feb. 8, 2022

(54) LIQUID TAKING DEVICE AND LIQUID TAKING METHOD

(71) Applicants: Institute of Rock and Soil Mechanics, Chinese Academy of Sciences, Hubei (CN); China Petroleum & Chemical Corporation LTD Gas Storage Branch, Zhengzhou (CN); Jiangsu Suyan Jingshen Co., Ltd., Huai'an (CN)

(72) Inventors: Hongling Ma, Wuhan (CN); Yuhao Zhang, Wuhan (CN); Xilin Shi, Wuhan (CN); Chunhe Yang, Wuhan (CN); Yinping Li, Wuhan (CN); Hongwu Yin, Wuhan (CN); Shuanglong Ding, Hubei Province (CN); Qingfeng Lu, Huai'an (CN); Kai Liu, Huai'an (CN)

( * ) Notice: Subject to any disclaimer, the term of this patent is extended or adjusted under 35 U.S.C. 154(b) by 0 days.

(21) Appl. No.: 16/810,849

(22) Filed: Mar. 6, 2020

(65) Prior Publication Data

US 2020/0378257 A1 Dec. 3, 2020

(30) Foreign Application Priority Data

May 28, 2019 (CN) ..... 201910453770.4

(51) Int. Cl.

| | |
|---|---|
| ***E21B 43/28*** | (2006.01) |
| ***G01N 1/10*** | (2006.01) |
| ***E21F 16/00*** | (2006.01) |
| ***E21F 17/16*** | (2006.01) |
| *E21B 49/08* | (2006.01) |

(52) U.S. Cl.

CPC ..... *E21F 16/00* (2013.01); *E21F 17/16* (2013.01); *E21B 49/08* (2013.01)

(58) Field of Classification Search

CPC ..... E21F 16/00; E21F 17/16; E21B 49/08; E21B 43/28; E21B 47/00; E21B 49/087; E21B 49/088; E21B 47/04; E21B 49/005; G01N 1/10; B01D 53/265; B65G 5/00; C01B 3/00; C01B 3/506; F17C 3/005

See application file for complete search history.

(56) References Cited

U.S. PATENT DOCUMENTS 1,758,011 A * 5/1930 Reach ..... A63B 47/04 15/21.2
2,126,006 A * 8/1938 Gross ..... A63D 15/005 473/4

(Continued)

*Primary Examiner* — Edwin J Toledo-Duran

(57) ABSTRACT

The disclosure provides a liquid taking device and a liquid taking method. The liquid taking device comprises a liquid taking bottle, a heavy ball and liquid taking ropes. The liquid taking bottle has a first mouth and a bottom opposite to the first mouth. The heavy ball is arranged in the liquid taking bottle. The liquid taking device can be controlled to reach different depths under the ground by the action of two liquid ropes. When the first mouth of the bottle is placed facing downward, the heavy ball blocks the first mouth of the bottle under its own gravity to prevent liquid leakage; when the first mouth of the bottle is turned upwards under the action of the liquid taking rope, the heavy ball falls onto the bottom of the bottle, such that an external liquid can flow into the liquid taking device, which has a good practical utility.

9 Claims, 3 Drawing Sheets

(56) References Cited

U.S. PATENT DOCUMENTS 2,425,919 A * 8/1947 Cox ..... C25C 5/02 205/74
2,714,722 A * 8/1955 Griffon ..... E03D 3/10 4/357
2,764,155 A * 9/1956 Meyers ..... A61J 11/002 215/11.4
2,818,733 A * 1/1958 Stanley, Jr. ..... G01N 1/18 73/426
3,138,278 A * 6/1964 Butts ..... A61J 9/04 215/11.1
3,146,919 A * 9/1964 Chappell ..... G01F 11/265 222/212
3,547,296 A * 12/1970 Greenberg ..... A61J 9/006 215/11.4
3,614,891 A * 10/1971 Nolte ..... G01S 15/88 73/152.15
3,648,697 A * 3/1972 Gardner ..... A61M 5/1486 604/408
3,720,240 A * 3/1973 Gardner ..... A61M 5/1486 141/9
4,125,200 A * 11/1978 Manley ..... B65D 39/06 215/246
4,174,107 A * 11/1979 Hickey ..... A63B 69/0079 220/375
4,310,038 A * 1/1982 Yule ..... G01F 11/32 141/351
RE31,074 E * 11/1982 Nolte ..... E21B 47/003 73/152.58
4,534,070 A * 8/1985 Hauptmann ..... E03D 9/038 116/227
4,741,448 A * 5/1988 Alley ..... B65D 39/06 215/266
5,460,160 A * 10/1995 Parrott ..... F24V 30/00 126/263.01
5,924,606 A * 7/1999 Huizing ..... B65D 49/06 222/500
6,648,184 B1 * 11/2003 Williams ..... B67D 3/0032 222/146.6
9,115,542 B1 * 8/2015 Calvert ..... E21B 4/04
2006/0255170 A1 * 11/2006 Kim ..... A47G 21/18 239/33
2007/0147944 A1 * 6/2007 Lockhart ..... A63B 47/04 401/11
2010/0264161 A1 * 10/2010 Woodruff ..... B65D 1/32 222/1
2010/0282004 A1 * 11/2010 Nance ..... F16K 31/001 73/864.63
2010/0307637 A1 * 12/2010 Dirst ..... B67D 1/1238 141/11
2011/0101037 A1 * 5/2011 Ghavami-Nasr .... B65D 83/425 222/402.2
2012/0329367 A1 * 12/2012 Fitchett ..... A63B 37/0005 451/5
2016/0060038 A1 * 3/2016 Oates ..... B01D 53/265 405/56
2016/0101366 A1 * 4/2016 Carroll ..... G10K 1/071 446/419
2017/0129688 A1 * 5/2017 Murrell-Cole ..... B65D 41/04
2018/0000289 A1 * 1/2018 Almaraz, II ..... B01F 7/0095
2018/0162582 A1 * 6/2018 Deylamian ..... B65D 41/0471
2018/0213956 A1 * 8/2018 Ou ..... C03B 23/07
2018/0214832 A1 * 8/2018 Sussi ..... A61J 11/02
2019/0365988 A1 * 12/2019 Kim ..... A61M 5/1414

* cited by examiner

LIQUID TAKING DEVICE AND LIQUID TAKING METHOD

CROSS-REFERENCE

This application claims the benefit of Chinese Patent Application No. 201910453770.4 entitled "LIQUID TAKING DEVICE AND LIQUID TAKING METHOD" and filed on May 28, 2019, which is incorporated herein by reference in its entirety.

TECHNICAL FIELD

The disclosure relates to the technical field of liquid taking, and in particular to a liquid taking device and a liquid taking method.

BACKGROUND OF THE INVENTION

At present, during the utilization of underground salt mine space, it involves analysis of liquid composition at a certain depth in the underground salt cavern, and taking out the liquid at a certain depth is the first problem to be faced.

However, there is only a pipe string connecting underground salt cavern and ground surface, and a diameter of the pipe string is too small to allow a large equipment being passed through; at the same time, as the brine under the ground is corrosive, the existing electronic liquid taking device is not suitable for use.

SUMMARY OF THE INVENTION

The technical problem to be solved by the present disclosure is to overcome the deficiencies of the prior art, and provide a liquid taking device and a liquid taking method which can take brine from deep underground salt cavern.

In order to achieve the aforementioned object, the present disclosure adopts the following technical solutions.

In an aspect, provided herein is a liquid taking device, comprising a liquid taking bottle, a heavy ball, and two control ropes. The liquid taking bottle has a first mouth and a bottom opposite to the first mouth. The heavy ball is arranged inside the liquid taking bottle, and a diameter of the heavy ball is larger than a diameter of the bottle mouth. One control rope is connected to the first mouth of the bottle, and another control rope is connected to the bottom of the bottle.

In some embodiments, the liquid taking device may further comprise two gravity blocks. One gravity block is connected between the one control rope and the first mouth of the bottle, and another gravity block is connected between another control rope and the bottom of the bottle.

In some embodiments, the liquid taking bottle may comprise a first bottle body and a second bottle body arranged opposite to the first bottle body. The first bottle body and the second bottle body have opposite ends detachably connected to each other, and the opposite ends of the first bottle body and the second bottle body have a diameter larger than the diameter of the heavy ball. The first bottle body and the second bottle body have ends facing away each other, which are respectively provided with the first mouth of the bottle and the bottom of the bottle.

In some embodiments, the bottom of the bottle may comprise a second mouth and a sealing sleeve, and the sealing sleeve is arranged on the second mouth of the bottle.

In some embodiments, the bottom of the bottle may comprise a ball-filling hole and a ball-filling hole cap, a diameter of the ball-filling hole is greater than the diameter of the heavy ball, and the ball-filling hole cap is arranged on the ball-filling hole.

In some embodiments, the heavy ball has a surface covered with an elastic layer.

In another aspect, provided herein is a liquid taking method, applied to a liquid taking device, the liquid taking device takes brine from within an underground salt cavern, the liquid taking device including a liquid taking bottle, a heavy ball and two control ropes, the liquid taking bottle has a first mouth and a bottom opposite to the first mouth; the heavy ball is disposed inside the liquid taking bottle and has a diameter larger than a diameter of the first mouth; one control rope is connected to the first mouth of the bottle, and another control rope is connected to the bottom of the bottle, wherein the liquid taking method comprising:

filling a displacement liquid into the liquid taking bottle;

controlling the first mouth of the liquid taking bottle to face downward via the control ropes, and placing the liquid taking device into a liquid to be taken;

controlling the first mouth of the liquid taking bottle to face upward via the control ropes, such that the liquid taking bottle is filled with the liquid to be taken; and controlling the first mouth of the liquid taking bottle to face downward again via the control ropes, and taking out the liquid taking device from the liquid to be taken.

In some embodiments, the displacement liquid is a liquid having a density smaller than that of brine and does not react with the brine.

In some embodiments, placing the liquid taking device into the liquid to be taken comprises:

controlling the control rope connected to the bottom of the bottle to suspend the liquid taking device;

controlling the control rope connected to the first mouth of the bottle to be loosened freely; and controlling the control rope connected to the bottom of the bottle to be descended, and lowering the liquid taking device to a designated depth.

In some embodiments, controlling the first mouth of the liquid taking bottle to face upward comprises:

controlling the control rope connected to the first mouth of the bottle to be ascended; and controlling the control rope connected to the bottom of the bottle to be descended.

Provided herein are the liquid taking device and the liquid taking method. Since the first mouth and the bottom of the liquid taking device are both connected with control ropes, the liquid taking device can be controlled to reach different depths under the ground by the action of two control ropes. Additionally, when the first mouth of the bottle is placed facing downward, the heavy ball blocks the first mouth of the bottle by its own gravity to prevent liquid leakage. When the first mouth of the bottle is turned upwards under the action of the control rope, the heavy ball fall onto the bottom of the bottle, so that the displacement liquid, which density is smaller than the external liquid, will escape from the mouth of the bottle and the external liquid can flow into the liquid taking device, thereby achieving the purpose of liquid taking. Through the synergistic actions between the control ropes and the heavy ball, the brine deep under the ground can be taken out simply and effectively, which has a good practical utility.

BRIEF DESCRIPTION OF THE DRAWINGS

In order to explain the technical solutions of the embodiments of the present disclosure more clearly, the drawings used in the description of the embodiments are briefly introduced below. Obviously, the drawings in the following description only represent some embodiments of the present disclosure. For those of ordinary skill in the art, other drawings can be obtained according to these drawings without paying creative labor.

DETAILED DESCRIPTION OF THE INVENTION

In the following, the technical solutions of the embodiments of the present disclosure will be clearly and completely described with reference to the drawings of the embodiments of the present disclosure. Obviously, the described embodiments are only part of embodiments of the present disclosure, but not all of embodiments. Based on the embodiments of the present disclosure, all other embodiments obtained by those of ordinary skill in the art without creative efforts are intended to be within the protection scope of the present disclosure.

Figure 1:
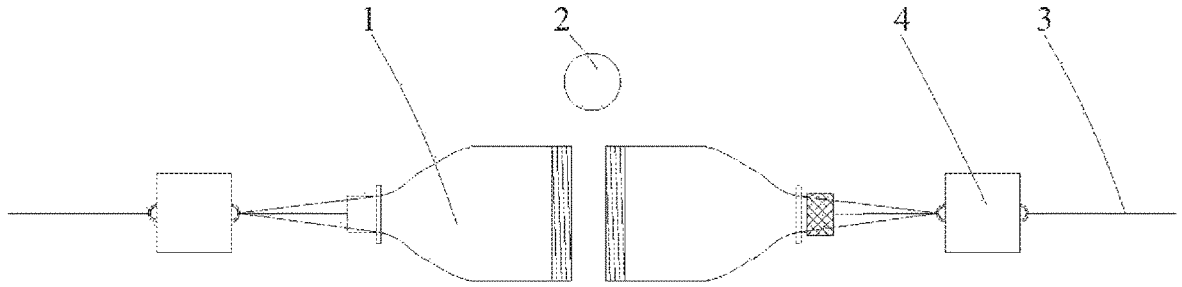
FIG. 1 illustrates a schematic front structural view of a liquid taking device according to an embodiment of the present disclosure.

In one aspect of the disclosure, a liquid taking device is provided, as shown in FIG. 1.

Figure 2:
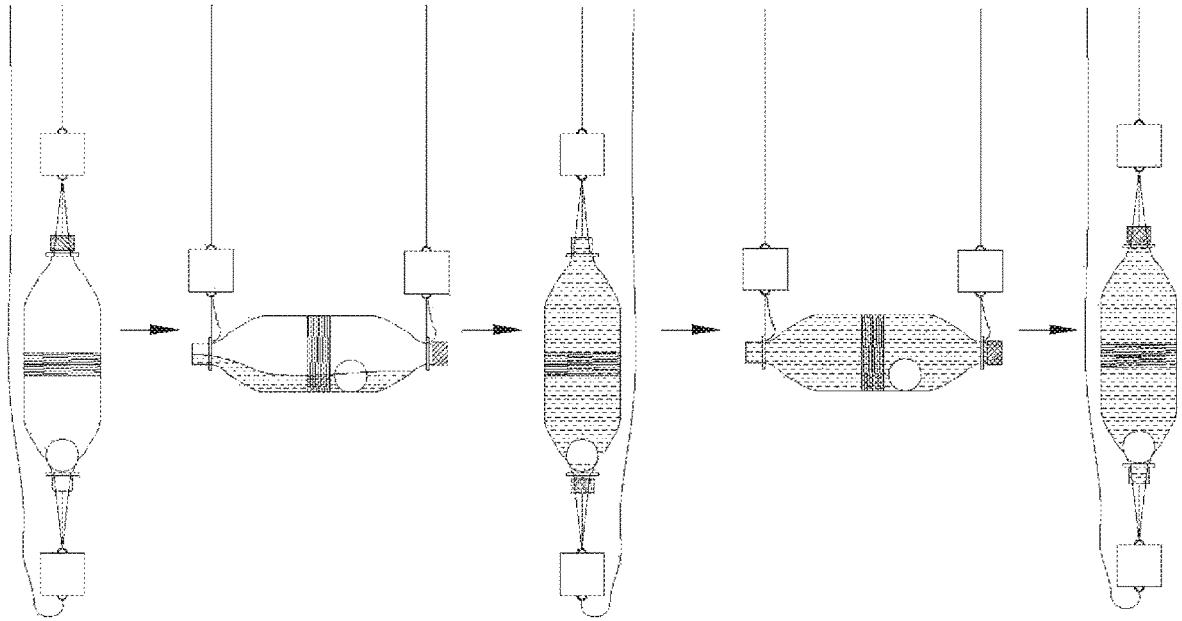
FIG. 2 illustrates a schematic diagram showing a changing state of a liquid taking device of the present disclosure when a liquid is taking.
Figure 3:
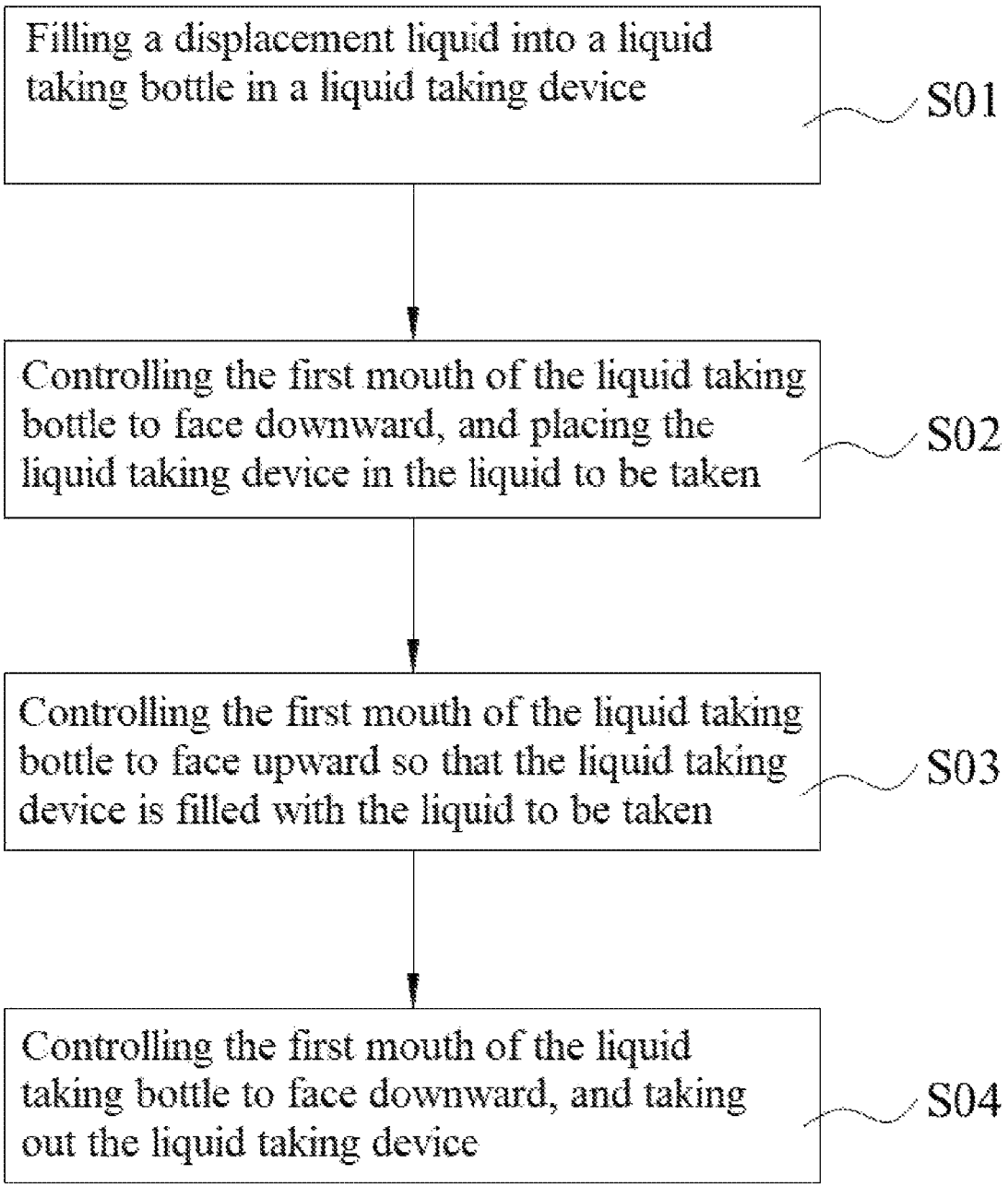
FIG. 3 illustrates a flowchart of a liquid taking method according to one or more embodiments of the present disclosure.

FIG. 2 illustrates a schematic diagram showing a changing state of a liquid taking device while a liquid is taking. FIG. 3 illustrates a flowchart of a liquid taking method according to an embodiment of the present disclosure. With reference to FIG. 2 and FIG. 3, a liquid taking method according to an embodiment of the present disclosure may comprise the following steps:

S01, Filling a displacement liquid into a liquid taking bottle in a liquid taking device.

In step S01, the liquid taking device used is a liquid taking device for taking salt mine brine. The structure of the liquid taking device is shown in FIG. 1. The liquid taking device may comprise a liquid taking bottle 1, a heavy ball 2 and a control rope 3. The liquid taking bottle 1 has a first mouth and a bottom opposite to the first mouth. The heavy ball 2 is disposed inside the taking bottle 1. A diameter of the heavy ball 2 is larger than a diameter of the mouth of the bottle. There are two control ropes 3, wherein one control ropes 3 is connected to the first mouth of the bottle, and another control ropes 3 is connected to the bottom of the bottle.

The heavy ball 2 can be rolled inside the liquid taking bottle 1. When the first mouth of the liquid taking bottle 1 is placed downward, the heavy ball falls into the first mouth and blocks the first mouth, such that the displacement liquid in the liquid taking bottle will not leak out. When the first mouth of the liquid taking bottle 1 is placed upward, the heavy ball will fall at the bottom of the bottle; and at this point the first mouth of the bottle is opened, such that the brine under the ground will enter the liquid taking bottle 1 and the displacement liquid in the liquid taking bottle 1 is displaced.

In some embodiments, the liquid taking bottle 1 can be raised, lowered, or turned over under the cooperation of the two control ropes 3. When one control rope 3 is loosened and another control rope 3 hangs the liquid taking bottle 1, the liquid taking bottle 1 will rise with the rising of another control rope 3, and the liquid taking bottle 1 will also fall with the falling of the other control rope 3. In the case that the two control ropes 3 are tensioned to suspend the liquid taking bottle 1 at the same time, when one control rope 3 does not move while another control rope 3 is rising, the portion of the liquid taking bottle 1 connected with the rising control rope 3 can be controlled to rise. When the position of one end of the liquid taking bottle 1 rise above the position of the other end thereof, the turn-over of the liquid taking bottle is completed.

In some embodiments, the displacement liquid may be a liquid having a density smaller than that of the brine and does not react with the brine, such as oil. As the displacement is ongoing, only when the density of the displacement liquid is smaller than the density of the brine, can the brine smoothly flow into the bottle; and only when the displacement liquid does not react with the brine, can the composition of the brine being taken out not be affected. In addition, displacement liquid filled in the liquid taking bottle 1 can increase the weight of the bottle and facilitate the liquid taking device to be lowered to a designated position in the brine under the action of the buoyancy of the brine.

In some embodiments, the liquid taking device may further comprise the gravity block 4. There may be two gravity blocks 4, wherein one gravity blocks 4 is connected between one control rope 3 and the first mouth of the bottle, and another gravity block 4 is connected between another liquid rope 3 and the bottom of the bottle. The gravity block 4 increases the weight of the liquid taking device, which can facilitate the liquid taking device to be lowered into the brine. The gravity block 4 may be positioned at the end of the control rope 3, which can facilitate the liquid ropes 3 to adjust the relative positions of the first mouth and the bottom of the liquid taking bottle 1 by the aid of the gravity of the gravity block 4, such that the liquid taking bottle 1 can be conveniently controlled.

In some embodiments, the liquid taking bottle 1 may comprise a first bottle body and a second bottle body. The first bottle body and the second bottle body are arranged to opposite each other. The first bottle body and the second bottle body have opposite ends detachably connected with each other by threads, and the opposite ends of the first bottle body and the second bottle body have a diameter larger than the diameter of the heavy ball 2. That is, the first bottle body and the second bottle body can be separated from each other. When the first bottle body and the second bottle body are separated, the heavy ball 2 can be filled in, and then the first bottle body is connected to the second bottle body by thread so as to prevent the heavy ball from falling out. In addition, the ends of the first bottle body and the second bottle body facing away from each other are respectively provided with the first mouth and the bottom of the bottle. The mouth of the bottle is opposite to the bottom of the bottle, which is convenient for adjusting the orientation of the first mouth of the liquid taking bottle 1, such that the liquid can be taken out easily.

In some embodiments, the bottom of the bottle may comprise a second mouth and a sealing sleeve, and the sealing sleeve is arranged on the second mouth. When the bottom of the bottle is used as the second mouth, the structure of the first bottle body is basically the same as that of the second bottle body. The second bottle body can be formed by arranging a sealing sleeve to the first mouth of the first bottle body, so the second bottle body and the first bottle body can be produced together, thus saving production costs.

In some embodiments, the surface of the heavy ball 2 is covered with an elastic layer, and the elastic layer may be a substance having elasticity such as rubber. With the weight of the heavy ball itself and the hydraulic pressure in the liquid, the elastic layer on the surface of the gravity ball can be slightly squeezed into the first mouth of the bottle, so that the sealing effect of the heavy ball 2 is increased.

The method may further comprise step S02, controlling the first mouth of the liquid taking bottle to face downward, and placing the liquid taking device in the liquid to be taken.

In some embodiments, in step S02, controlling the first mouth of the liquid taking bottle 1 to face downward, and placing the liquid taking device in the liquid to be taken may comprise:

Placing the liquid taking bottle vertically, and extending the control rope 3 connected to the first mouth of the bottle downward until the control rope 3 connected to the first mouth of the bottle is no longer stressed; the first mouth of the entire liquid taking bottle 1 is facing downwards and the gravity of the entire liquid taking bottle 1 is borne by the control rope 3 connected to the bottom of the bottle, that is, the liquid taking bottle 1 is suspended by the control rope 3 connected to the bottom of the bottle.

When the liquid taking bottle 1 is suspended by the control rope 3 connected to the bottom of the bottle, the two control ropes 3 are lowered at the same speed so that the force applied to the control ropes 3 remains unchanged. When the control ropes are lowered to a certain degree and the liquid taking bottle 1 arrives at a position for taking liquid, the lowering of the liquid taking bottle 1 is stopped, thereby the positioning of the liquid taking bottle 1 is completed.

The method may further comprise step S03, controlling the first mouth of the liquid taking bottle to face upward so that the liquid taking device is filled with the liquid to be taken.

In some embodiments, in step S03, controlling the first mouth of the liquid taking bottle to face upward may comprise:

Slowly lifting the control rope 3 connected to the first mouth, and the first mouth will rise with the rising of the control rope 3 at this point. However, in order to ensure that the position of the liquid taking bottle 1 remains unchanged, it is necessary to lower the other control rope 3 connected to the bottom of the bottle at the same speed when the first mouth of the bottle starts to rise. At this point, the liquid taking bottle 1 will rotate around its center so that the first mouth is raised and the bottom of the bottle is lowered, and the heavy ball 2 in the liquid taking bottle 1 will leave from the first mouth of the bottle, and at this point the brine will flow into through the first mouth of the bottle and the low-density displacement liquid is displaced. When the height of the first mouth of the bottle exceeds the height of the bottom of the bottle, the heavy ball 2 will roll onto the bottom of the bottle and the entire liquid taking bottle 1 is filled with the brine.

The method may further comprise step S04, controlling the first mouth of the liquid taking bottle to face downward, and taking out the liquid taking device.

In some embodiments, in step S04, after the entire liquid taking bottle 1 is filled with the brine, the liquid taking device needs to be taken out. At this point, the liquid taking bottle 1 needs to be turned over again, and then taken out. Therefore, the control rope 3 connected to the first mouth needs to be slowly lowered. At this point, the first mouth of the bottle will be lowered with the control rope 3 being lowered. However, in order to ensure that the position of the liquid taking bottle 1 remains unchanged, it is necessary to raise another control rope 3 connected to the bottom of the bottle at the same speed when the first mouth of the bottle starts to descend, and at that point the liquid taking bottle 1 will rotate around its center so that the first mouth of the bottle is lowered and the bottom of the bottle is raised, and the heavy ball 2 in the liquid taking bottle 1 will leave from the bottom of the bottle. When the position of the first mouth of the bottle is lower than the position of the bottom of the bottle, the heavy ball 2 will roll into the first mouth and block the first mouth. When the liquid taking bottle 1 returns to its vertical state, the heavy ball 2 will completely block the first mouth of the bottle, until the entire liquid taking bottle 1 is suspended again only by the control rope 3 connected to the bottom of the bottle. When the liquid taking bottle 1 is suspended by the control rope 3 connected to the bottom of the bottle, the two control ropes 3 are raised at the same speed so that the force applied to the control ropes 3 remain unchanged until the liquid taking device is completely taken out.

Figure 4:
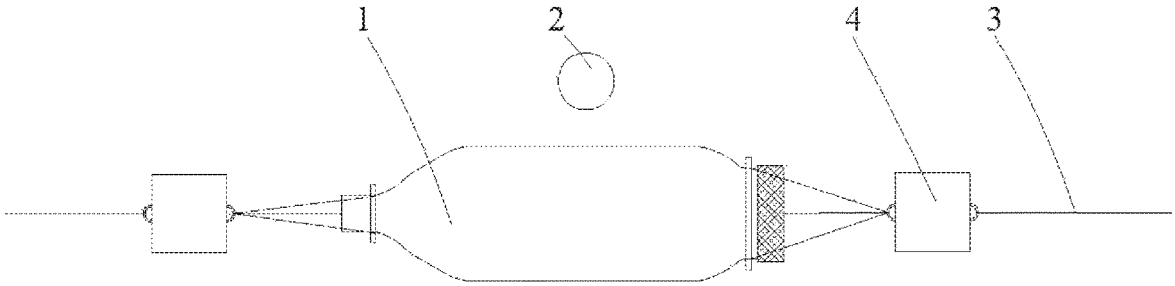
FIG. 4 illustrates a schematic front structural view of a liquid taking device according to another embodiment of the present disclosure.

As another embodiment of the present disclosure, what is different from the aforementioned embodiment is that the bottle body of the liquid taking bottle 1 in this embodiment is made integrally. FIG. 4 illustrates a schematic front structural view of the liquid taking device in this embodiment. The bottom of the bottle may comprise a ball-filling hole and a ball-filling hole cap. The diameter of the ball-filling hole is larger than the diameter of the heavy ball 2. The heavy ball 2 can be put in through the ball-filling hole. The ball-filing hole cap is arranged on the ball-filling hole to prevent the heavy ball 2 from falling out.

The embodiments of the present specification provide a liquid taking device and a liquid taking method. Since the first mouth and the bottom of the liquid taking device are both connected with a control rope, the liquid taking device can be controlled to reach different depths under the ground by the action of two control ropes. When the first mouth of the bottle is placed downwards, the heavy ball blocks the first mouth under its own gravity to prevent liquid leakage. When the first mouth of the bottle is turned upwards under the action of the control ropes, the heavy ball falls into the bottom of the bottle so that the external liquid can flow into the liquid taking device, thereby achieving the purpose of liquid taking. Through the synergistic actions between the control ropes and the heavy ball, the brine deep under the ground can be taken out simply and effectively, which has a good practical utility.

What is claimed is:

1. A liquid taking method, applied to a liquid taking device, the liquid taking device takes brine from within an underground salt cavern, the liquid taking device including a liquid taking bottle (1), a heavy ball (2) and two control ropes (3), the liquid taking bottle (1) has a first mouth and a bottom opposite to the first mouth; the heavy ball (2) is disposed inside the liquid taking bottle (1) and has a diameter larger than a diameter of the first mouth; one control rope is connected to the first mouth of the bottle, and another control rope is connected to the bottom of the bottle, wherein the liquid taking method comprising:

filling a displacement liquid into the liquid taking bottle (1);

controlling the first mouth of the liquid taking bottle (1) to face downward via the control ropes (3), and placing the liquid taking device into a liquid to be taken;

controlling the first mouth of the liquid taking bottle (1) to face upward via the control ropes (3), such that the liquid taking bottle (1) is filled with the liquid to be taken; and controlling the first mouth of the liquid taking bottle (1) to face downward again via the control ropes (3), and taking out the liquid taking device from the liquid to be taken.

2. The liquid taking method of claim 1, wherein the displacement liquid is a liquid having a density smaller than that of brine and does not react with the brine.

3. The liquid taking method of claim 1, wherein the placing the liquid taking device into the liquid to be taken comprises:

controlling the control rope connected to the bottom of the bottle to suspend the liquid taking device;

controlling the control rope connected to the first mouth of the bottle to be loosened freely; and controlling the control rope connected to the bottom of the bottle to be descended, and thus lowering the liquid taking device to a designated height.

4. The liquid taking method of claim 1, wherein the controlling the first mouth of the liquid taking bottle to face upward via the control ropes (3) comprises:

controlling the control rope connected to the first mouth to be ascended; and controlling the control rope connected to the bottom of the bottle to be descended.

5. The liquid taking method of claim 1, wherein the liquid taking device further comprising two gravity block (4), one gravity block is connected between one control rope and the first mouth of the bottle, and another gravity block is connected between another control rope and the bottom of the bottle.

6. The liquid taking method of claim 1, wherein the liquid taking bottle (1) comprises a first bottle body and a second bottle body opposite to the first bottle body; the first bottle body and the second bottle body have opposite ends detachably connected with each other; the opposite ends of the first bottle body and the second bottle body have a diameter larger than the diameter of the heavy ball (2); and the first bottle body and the second bottle body have ends facing away from each other, which are respectively provided with the first mouth and the bottom of the bottle.

7. The liquid taking method of claim 6, wherein the bottom of the bottle comprises a second mouth and a sealing sleeve, and the sealing sleeve is disposed on the second mouth.

8. The liquid taking method of claim 1, wherein the bottom of the bottle comprises a ball-filling hole and a ball-filling hole cap; a diameter of the ball-filling hole is larger than the diameter of the heavy ball (2), and the ball-filling hole cap is arranged on the ball-filing hole.

9. The liquid taking method of claim 1, wherein the heavy ball (2) has a surface covered with an elastic layer.

* * * * *